US010598186B2

(12) United States Patent
Cappuccini et al.

(10) Patent No.: US 10,598,186 B2
(45) Date of Patent: Mar. 24, 2020

(54) METHOD FOR PREVENTING THE CORROSION OF AN IMPELLER-SHAFT ASSEMBLY OF A TURBOMACHINE

(71) Applicant: Nuovo Pignone Srl, Florence (IT)

(72) Inventors: Filippo Cappuccini, Florence (IT); Stefania Stramare, Florence (IT); Marco Romanelli, Florence (IT); Marco Anselmi, Florence (IT); Riccardo Paoletti, Florence (IT); Alessio Bandini, Florence (IT)

(73) Assignee: Nuovo Pignone SRL, Florence (IT)

( * ) Notice: Subject to any disclaimer, the term of this patent is extended or adjusted under 35 U.S.C. 154(b) by 334 days.

(21) Appl. No.: 15/310,943

(22) PCT Filed: May 13, 2015

(86) PCT No.: PCT/EP2015/060609
§ 371 (c)(1),
(2) Date: Nov. 14, 2016

(87) PCT Pub. No.: WO2015/173311
PCT Pub. Date: Nov. 19, 2015

(65) Prior Publication Data
US 2017/0130733 A1 May 11, 2017

(30) Foreign Application Priority Data
May 15, 2014 (IT) ..... CO2014A0015

(51) Int. Cl.
*F04D 29/22* (2006.01)
*F04D 29/26* (2006.01)
(Continued)

(52) U.S. Cl.
CPC ..... *F04D 29/2294* (2013.01); *B05D 1/12* (2013.01); *C23C 4/12* (2013.01); *C23C 18/1633* (2013.01);
(Continued)

(58) Field of Classification Search
CPC .... F04D 29/2294; F04D 29/28; F04D 29/628; F04D 29/624; F04D 29/043;
(Continued)

(56) References Cited

U.S. PATENT DOCUMENTS 2,428,728 A 10/1947 Watson
5,910,340 A 6/1999 Uchida et al.
(Continued)

FOREIGN PATENT DOCUMENTS

CN 1598025 A 3/2005
CN 201265043 Y 7/2009
(Continued)

OTHER PUBLICATIONS

Iacopo, G., et al., Production method of a coating layer for a piece of turbomachinery component, the component itself and the corresponding piece of machinery, GE co-pending Application No. CO2009A000024, filed on Jul. 15, 2009.
(Continued)

*Primary Examiner* — Moshe Wilensky
(74) *Attorney, Agent, or Firm* — Baker Hughes Patent Organization

(57) ABSTRACT

A method for preventing corrosion of an impeller-shaft assembly of a turbomachine comprises the steps of assembling an impeller on a shaft in order to define an impeller-shaft assembly; plating the assembly by inserting the assembly into a plating bath; and coating at least a first predefined
(Continued)

surface on the impeller and a second predefined surface on the shaft wherein the coating step is performed by spraying the predefined surfaces.

22 Claims, 2 Drawing Sheets

(51) Int. Cl.

| | |
|---|---|
| ***F01D 5/34*** | (2006.01) |
| ***F01D 25/00*** | (2006.01) |
| ***F04D 29/02*** | (2006.01) |
| ***B05D 1/12*** | (2006.01) |
| ***C23C 4/12*** | (2016.01) |
| ***C23C 18/16*** | (2006.01) |
| ***C23C 18/32*** | (2006.01) |
| ***C23F 11/00*** | (2006.01) |
| ***C25D 3/04*** | (2006.01) |
| ***C25D 3/12*** | (2006.01) |
| ***F04D 29/043*** | (2006.01) |
| ***F04D 29/053*** | (2006.01) |
| ***F04D 29/28*** | (2006.01) |
| ***F04D 29/62*** | (2006.01) |

(52) U.S. Cl.
CPC ..... *C23C 18/32* (2013.01); *C23F 11/00* (2013.01); *C25D 3/04* (2013.01); *C25D 3/12* (2013.01); *F01D 5/34* (2013.01); *F01D 25/007* (2013.01); *F04D 29/023* (2013.01); *F04D 29/043* (2013.01); *F04D 29/053* (2013.01); *F04D 29/266* (2013.01); *F04D 29/28* (2013.01); *F04D 29/624* (2013.01); *F04D 29/628* (2013.01); *F05D 2230/90* (2013.01); *F05D 2260/95* (2013.01); *F05D 2300/132* (2013.01); *F05D 2300/16* (2013.01); *F05D 2300/17* (2013.01); *F05D 2300/171* (2013.01); *F05D 2300/611* (2013.01)

(58) Field of Classification Search
CPC .... F04D 29/053; F04D 29/023; F04D 29/266; C25D 3/04; C25D 3/12; C23C 18/32; C23C 18/1633; C23C 4/12; C23F 11/00; B05D 1/12; F01D 5/34; F01D 25/007
See application file for complete search history.

(56) References Cited

U.S. PATENT DOCUMENTS

| | | | | |
|---|---|---|---|---|
| 2002/0001522 | A1* | 1/2002 | Mukherjee | F04D 25/04 416/185 |
| 2005/0111985 | A1 | 5/2005 | Chen et al. | |
| 2009/0263237 | A1 | 10/2009 | Box et al. | |
| 2010/0104457 | A1 | 4/2010 | Daimer et al. | |
| 2011/0146044 | A1* | 6/2011 | Pecherzewski | B25B 27/00 29/278 |
| 2014/0154070 | A1* | 6/2014 | Reid | F01D 11/003 415/209.2 |

FOREIGN PATENT DOCUMENTS

| | | | |
|---|---|---|---|
| CN | 101838833 | A | 9/2010 |
| CN | 102131961 | A | 7/2011 |
| EP | 0651169 | A1 | 5/1995 |
| EP | 1314887 | A2 | 5/2003 |
| EP | 2058417 | A1 | 5/2009 |
| EP | 2275688 | A2 | 1/2011 |
| EP | 2 836 626 | A2 | 2/2015 |

OTHER PUBLICATIONS

Riccardo, P., et al., Method for producing a protective coating for a component of a turbomachine, the component itself and the respective machine, GE co-pending Application No. MI2009A000405, filed on Mar. 17, 2009.

First Office Action and Search issued in connection with corresponding CN Application No. 201580025222.1 on Sep. 4, 2017.

Unofficial English Translation of Italian Search Report and Written Opinion issued in connection with Corresponding IT Application No. CO2014A000015 on Jan. 12, 2015.

PCT Search Report and Written Opinion issued in connection with Corresponding Application No. PCT/EP2015/060609 dated Oct. 19, 2015.

* cited by examiner

METHOD FOR PREVENTING THE CORROSION OF AN IMPELLER-SHAFT ASSEMBLY OF A TURBOMACHINE

BACKGROUND

The present embodiments relate to a method for preventing the corrosion of an impeller-shaft assembly of a turbomachine. The method of the present embodiments can be used for preventing corrosion in a component of a subsea or onshore or offshore turbomachine. In the following disclosure reference will be made specifically to a centrifugal compressor for ease of description only; no limitation on the applicability of the present disclosure is however intended.

Materials like carbon steel, low-alloy steel and stainless steel are normally used when building components which operate in subsea or onshore or offshore environments. If such environments comprise wet carbon dioxide (CO2) and/or wet hydrogen sulfide (H2S), carbon steel and low-alloy steel will be affected by corrosion damages. Moreover, if such environments comprise chlorides, stainless steel will be affected by pitting corrosion damages.

A method for preventing the corrosion of an impeller-shaft assembly of a turbomachine is known in the art. Indeed, an impeller-shaft assembly of a turbomachine can be made of a corrosion resistant alloy, for example a stainless steel or nickel alloy. This is done when the turbomachine is intended to operate in a corrosive environment.

BRIEF DESCRIPTION

A disadvantage of the above described prior art is that it incurs into significant costs, as corrosion-resistant alloys are significantly more expensive than low-alloy steel.

A first aspect of the invention is therefore directed to a method for preventing corrosion of an impeller-shaft assembly of a turbomachine comprising the steps of assembling an impeller on a shaft in order to define an impeller-shaft assembly. A first predefined surface on the impeller and a second predefined surface on the shaft are coated. The assembly is plated after the coating step, by inserting it into a plating bath. In an embodiment, this allows spraying or electroplating easily the surface that can be hard to reach when the impeller is assembled on the shaft.

Such method makes it possible to build an impeller-shaft assembly for use in a corrosive environment without resorting to expensive alloys. Indeed, the pieces are coated by inserting them into a plating bath. The components are also coated onto surfaces which are, when assembled, inside gaps or other places that are difficult to reach by the plating solution inside the bath. Between the coating and the plating the entire assembly is thus protected from the corrosion, and can therefore be made from a low-alloy steel or carbon steel.

In another aspect of the invention, the step of plating is performed by electroless nickel plating. In an embodiment, if the plating is performed on the entire assembly, as in the case in the above method, a degradation of the plating is prevented during assembly. Such degradation would happen if the plating were to be performed on the impeller and on the shaft separately, as one of them needs to be heated for the assembly step.

BRIEF DESCRIPTION OF THE DRAWINGS

Further details and specific embodiments will refer to the attached drawings, in which.

DETAILED DESCRIPTION

The following description of exemplary embodiments refer to the accompanying drawings. The same reference numbers in different drawings identify the same or similar elements. The following detailed description does not limit the application. Instead, the scope of the application is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Therefore, a method for preventing corrosion of an impeller-shaft assembly of a turbomachine will be described by referring to the attached drawings, in which the impeller-shaft assembly will be referenced with the number 1.

The impeller-shaft assembly 1 comprises a shaft 3. The shaft is substantially cylindrical, and has a lateral surface 3*a*.

The impeller-shaft assembly 1 also comprises an impeller 2 mounted on the shaft 3. Specifically, the impeller 2 is coaxial with respect to the shaft 3. Therefore, the impeller-shaft assembly 1 has a central axis "A", which defines an axis of rotation for the shaft 3 and for the impeller 2. Additionally, the impeller 2 has an internal surface 2*a* which, in use, faces the shaft 3. Indeed, the greatest part of the internal surface 2*a* of the impeller 2 is actually in contact with the shaft 3. The impeller 2 also has an external surface 2*b* facing outwardly with respect to the shaft 3.

Both the internal 2*a* and the external surface 2*b*, in case of operation in a chemically aggressive environment, can be treated to prevent damage to the impeller 2 itself. Further details will be given in a following part of the present disclosure.

Figure 1:
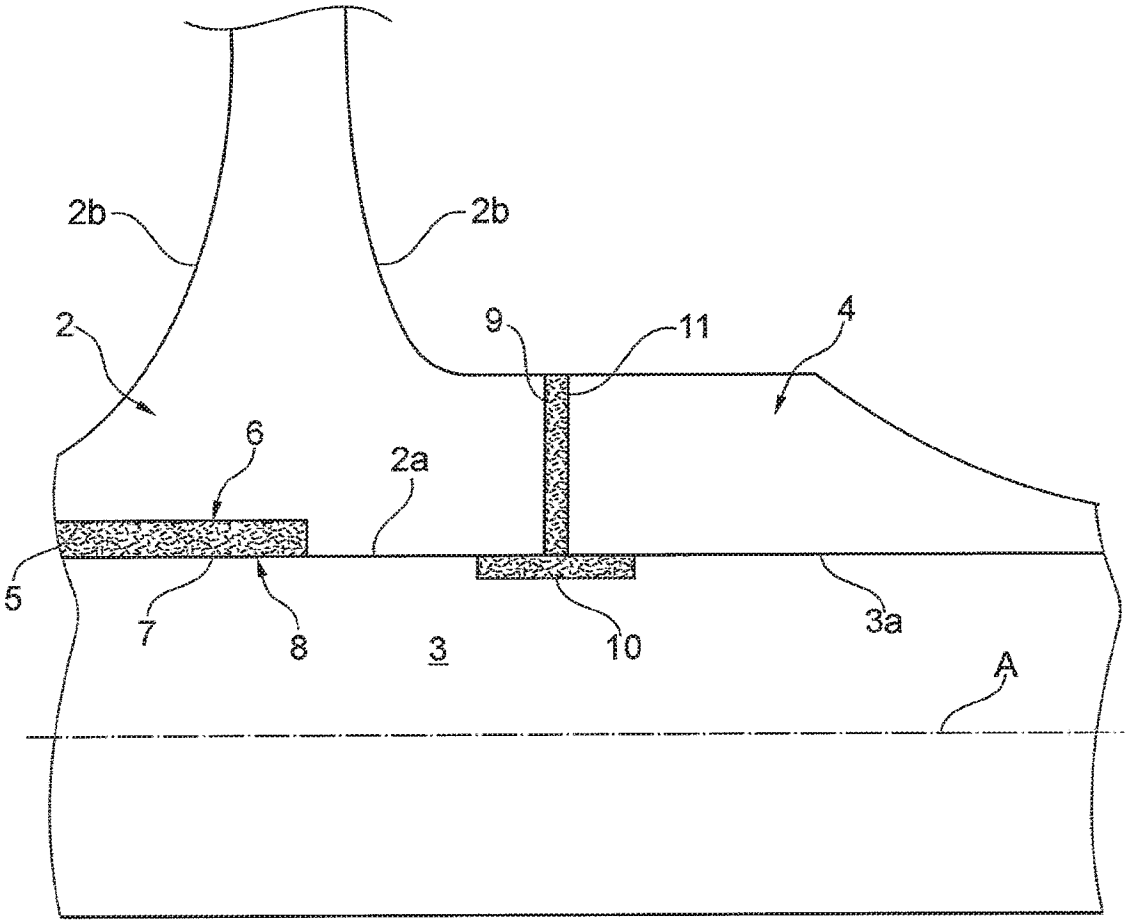
FIG. 1 is a schematic sectional lateral view of an impeller-shaft assembly according to an embodiment of the present invention.
Figure 2C:
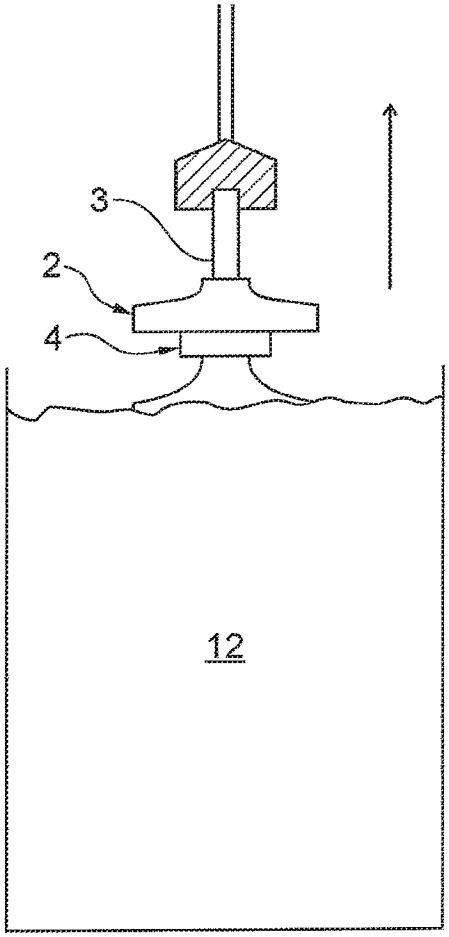
FIGS. 2A, 2B and 2C are schematic views of respective steps of a method for preventing corrosion of an impeller-shaft assembly according to an embodiment of the present invention.
Figure 2B:
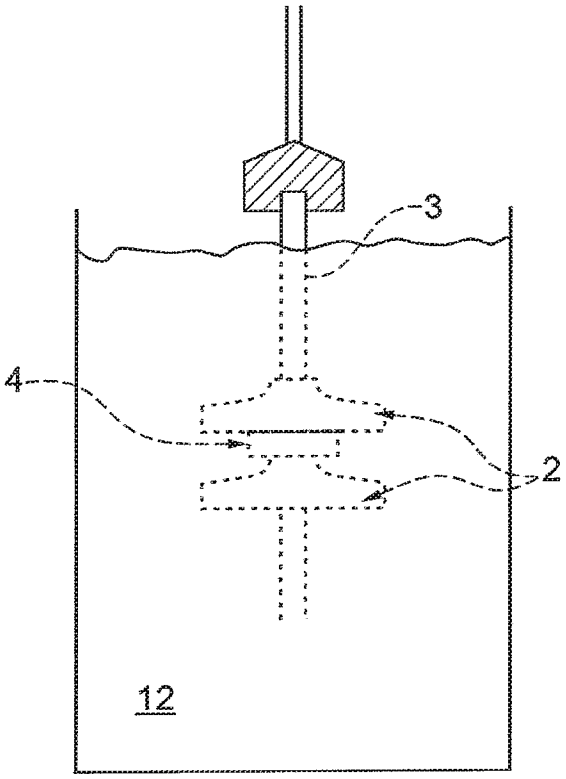
Figure 2A:
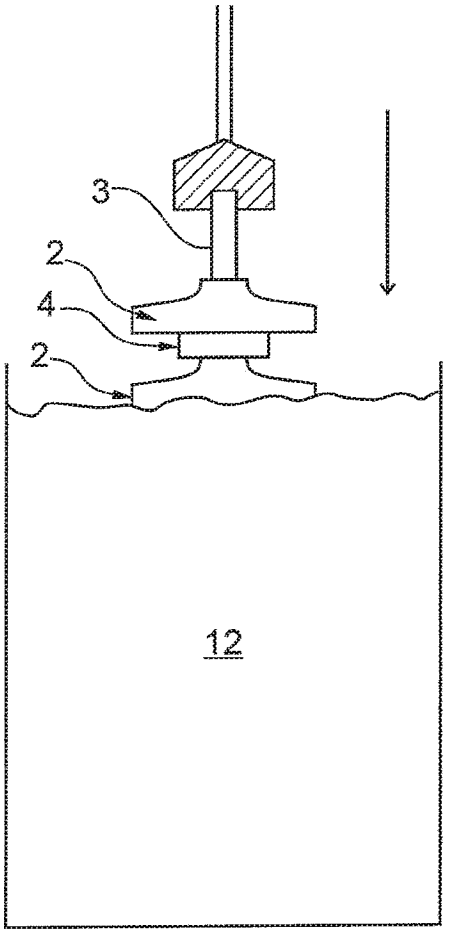

With additional detail, the impeller-shaft assembly 1 comprises a plurality of impellers 2. Between two consecutive impellers 2, the assembly 1 comprises a sleeve 4, which is attached to the shaft 3. According to the embodiment shown in FIG. 1, the central axis "A" of the shaft 3 can be regarded as an axis of symmetry of the sleeve 4.

An embodiment of the present invention therefore relates to a method for preventing corrosion of the impeller-shaft assembly 1. Such method comprises the steps of coating at least a first predefined surface 5 on the impeller 2. In an embodiment, such first predefined surface is part of the internal surface 2*a* which faced the shaft. Additionally, the impeller 2 may comprise a key slot 6 for reversibly attaching the impeller 2 itself to the shaft 3. The first predefined surface 5 is therefore the part of the internal surface 2*a* of the impeller 2 that defines the key slot 6.

A second predefined surface 7 is also coated in the same way as the first predefined surface 6. In an embodiment, the second predefined surface is part of the lateral surface 3*a* of the shaft 3. In an embodiment, the second predefined surface 7 is the surface of a key seat 8 which is configured to receive a key that is also inserted into the key slot 6 of the impeller 2 in order to attach the impeller 2 to the shaft 3.

According to the described embodiments of the invention, the step of coating the first 5 and the second predefined surface 7 is performed by spraying or electroplating them. In an embodiment of the invention, the first 5 and second predefined surface 7 are sprayed with a cold spray. Such cold spray can for example comprise solid powders made from nickel-based alloys, cobalt based alloys or stainless steel.

Cold spraying acts by kinetic effect, meaning that the particles composing the spray can embed themselves in a layer of the predefined surfaces 5, 7 by means of their kinetic energy. In an embodiment, this avoids any unwanted thermal treatment of the predefined surfaces 5, 7.

Alternatively, the step of coating the predefined surfaces 5, 7 can be performed by spraying them with a thermal spray. In this way, the temperature of the spray itself also treats the predefined surfaces 5, 7.

Alternatively, the step of coating the predefined surfaces 5, 7 can be performed by electroplating. The electroplating can be performed for example with electrolytic chromium or nickel.

If a sleeve 4 is to be included in the assembly 1, the step of coating may also comprise coating a third predefined surface 9 on the impeller 2. Such third predefined surface 9 is a portion of the surface of the impeller 2 which, in operation, faces the sleeve 4.

The step of coating may also comprise the coating of a fourth predefined surface 10. Such fourth predefined surface 10 is also onto the shaft 3. Specifically, the fourth predefined surface 10 is a portion of the lateral surface 3*a* of the shaft 3 which overlaps the impeller 2 and the sleeve 4.

The step of coating may also comprise the step of coating a fifth predefined surface 11. Such fifth predefined surface is located on the sleeve 4, specifically on a surface of the sleeve 4 which faces the impeller 2. In other words, the third 9 and the fifth predefined surface 11 face each other. The fourth predefined surfaces 10 bridges the gap between the third 9 and the fifth predefined surfaces 11.

The coating of the third 9, fourth 10 and fifth predefined surface 11 is performed in the same manner as the coating of the first 5 and of the second predefined surface 7. Concerning the above described coating methods (cold spray, thermal spray or electroplating), they can be applied in whatever combination is suitable for the specific purpose. In other words, the coating of the first 5, second 7 third 9, fourth 10 and fifth predefined surface 11 can be performed all with the same specific coating method or with any combination of them.

After the coating step, the impeller 2 is assembled on the shaft 3. Specifically, the impeller 2 is locked onto the shaft 3 by inserting a key (not shown in the figures) in the key slot 6 of the impeller 2. The key is also placed onto the key seat 8 of the shaft 3. If a sleeve 4 is used it is also installed in this step, by locking it between two impellers 2. The above operations are repeated for each impeller 2 and sleeve 4 which have to be installed onto the shaft 3.

According to an embodiment of the invention, the assembly 1 is then plated. In an embodiment, this is performed by inserting the assembly 1 into a plating bath and by pulling it out after a predefined time.

In an embodiment, the step of plating is performed by electroless nickel plating. Indeed, the step of plating comprises a first deposition sub-step, in which a first metallic layer is deposited on the assembly 1 substrate by electroplating. Afterwards, a second deposition step is performed, where at least a second layer of a nickel alloy is plated on the first layer by electroless plating. A thermal treatment step can then be performed after the deposition steps. The temperature and the duration of the thermal treatment depend on the overall thickness of the layers and on the final properties to be obtained.

Optionally, the plating step can include a third deposition step, in which a third metallic layer is deposited on the second layer by electroplating. A fourth deposition step of depositing a fourth layer of nickel alloy on the third layer by electroless plating can also optionally be performed.

It is to be understood that even though numerous characteristics and advantages of various embodiments have been set forth in the foregoing description, together with details of the structure and functions of various embodiments, this disclosure is illustrative only, and changes may be made in detail, especially in matters of structure and arrangement of parts within the principles of the embodiments to the full extent indicated by the broad general meaning of the terms in which the appended claims are expressed. It will be appreciated by those skilled in the art that the teachings disclosed herein can be applied to other systems without departing from the scope and spirit of the application.

What is claimed is:

1. A method for preventing corrosion of an impeller-shaft assembly of a turbomachine, the method comprising:

assembling an impeller on a shaft in order to define an impeller-shaft assembly;

plating the assembly by inserting the assembly into a plating bath; and coating at least a first predefined surface on the impeller and a second predefined surface on the shaft by spraying the predefined surfaces with a cold spray comprising particles of a nickel-based alloy or of stainless steel, wherein the coating step is performed before the assembling step.

2. The method according to claim 1, wherein the first predefined surface is a surface of a key slot on the impeller for attaching the impeller to the shaft.

3. The method according to claim 1, wherein the second predefined surface is the surface of a key seat on the shaft.

4. The method according to claim 1, wherein the assembling step comprises the sub-step of attaching a sleeve onto the shaft adjacent to the impeller; and the step of coating also comprises the step of coating a third predefined surface on the impeller and a fourth predefined surface on the shaft.

5. The method according to claim 4, wherein the third predefined surface is a portion of surface of the impeller designed to face the sleeve.

6. The method according to claim 4, wherein the fourth predefined surface is a portion of a lateral surface of the shaft designed to be arranged between the impeller and the sleeve.

7. The method according to claim 1, wherein the step of plating is performed by electroless nickel plating.

8. A method for preventing corrosion of an impeller-shaft assembly of a turbomachine, the method comprising:

assembling an impeller on a shaft in order to define an impeller-shaft assembly;

plating the assembly by inserting the assembly into a plating bath; and coating at least a first predefined surface on the impeller and a second predefined surface on the shaft by spraying the predefined surfaces with a thermal spray, wherein the coating step is performed before the assembling step.

9. The method according to claim 8, wherein the first predefined surface is a surface of a key slot on the impeller for attaching the impeller to the shaft.

10. The method according to claim 8, wherein the second predefined surface is the surface of a key seat on the shaft.

11. The method according to claim 8, wherein the assembling step comprises the sub-step of attaching a sleeve onto the shaft adjacent to the impeller; and the step of coating also comprises the step of coating a third predefined surface on the impeller and a fourth predefined surface on the shaft.

12. The method according to claim 11, wherein the third predefined surface is a portion of surface of the impeller designed to face the sleeve.

13. The method according to claim 11, wherein the fourth predefined surface is a portion of a lateral surface of the shaft designed to be arranged between the impeller and the sleeve.

14. The method according to claim 8, wherein the step of plating is performed by electroless nickel plating.

15. A method for preventing corrosion of an impeller-shaft assembly of a turbomachine, the method comprising:

assembling an impeller on a shaft in order to define an impeller-shaft assembly;

plating the assembly by inserting the assembly into a plating bath; and coating at least a first predefined surface on the impeller and a second predefined surface on the shaft by electroplating the predefined surfaces, wherein the coating step is performed before the assembling step.

16. The method according to claim 15, wherein the electroplating is performed by an electrolytic chromium or nickel plating process.

17. The method according to claim 15, wherein the first predefined surface is a surface of a key slot on the impeller for attaching the impeller to the shaft.

18. The method according to claim 15, wherein the second predefined surface is the surface of a key seat on the shaft.

19. The method according to claim 15, wherein the assembling step comprises the sub-step of attaching a sleeve onto the shaft adjacent to the impeller; and the step of coating also comprises the step of coating a third predefined surface on the impeller and a fourth predefined surface on the shaft.

20. The method according to claim 19, wherein the third predefined surface is a portion of surface of the impeller designed to face the sleeve.

21. The method according to claim 19, wherein the fourth predefined surface is a portion of a lateral surface of the shaft designed to be arranged between the impeller and the sleeve.

22. The method according to claim 15, wherein the step of plating is performed by electroless nickel plating.

* * * * *